US007792458B2

(12) United States Patent
Ota

(10) Patent No.: US 7,792,458 B2
(45) Date of Patent: Sep. 7, 2010

(54) IMAGE FORMING APPARATUS HAVING TONER IMAGE FORMING DEVICE

(75) Inventor: Mitsuhiro Ota, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 12/170,312

(22) Filed: Jul. 9, 2008

(65) Prior Publication Data

US 2009/0016762 A1 Jan. 15, 2009

(30) Foreign Application Priority Data

Jul. 10, 2007 (JP) ..... 2007-181111

(51) Int. Cl.
*G03G 21/00* (2006.01)

(52) U.S. Cl. ..... 399/98; 399/71; 399/74

(58) Field of Classification Search ..... 399/71, 399/74, 98, 99, 100, 49, 170, 171, 172
See application file for complete search history.

(56) References Cited

U.S. PATENT DOCUMENTS 7,167,661 B2 * 1/2007 Hatakeyama et al. ..... 399/98
7,457,553 B2 * 11/2008 Igarashi ..... 399/49
7,613,408 B2 * 11/2009 Karasawa et al. ..... 399/49 X
2005/0220469 A1 * 10/2005 Fujita et al. ..... 399/49
2005/0244178 A1 11/2005 Kitayama
2007/0065173 A1 * 3/2007 Sekovski et al. ..... 399/100

FOREIGN PATENT DOCUMENTS

JP 09-006203 A * 1/1997
JP 2005-316064 A 11/2005

* cited by examiner

*Primary Examiner*—Sophia S Chen
(74) *Attorney, Agent, or Firm*—Canon U.S.A., Inc. I.P. Division

(57) ABSTRACT

An image forming apparatus includes a toner image forming device configured to form a toner image on an image conveying member, a detector configured to optically detect a density of the toner image on the image conveying member, a controller configured to control an image forming condition of the toner image forming device based on an output of the detector, a shutter configured to open and close an optical window of the detector, wherein the image forming apparatus is operable in a cleaning mode of the shutter in which an opening and closing movement of the shutter is repeatedly executed.

6 Claims, 13 Drawing Sheets

FIG.5

| CONTAMINATION LEVEL OF SHUTTER | CONTAMINATION ON IMAGE (0.3 OR LESS) | CONTAMINATION ON IMAGE (MORE THAN 0.3) |
|---|---|---|
| A | 0 | 0 |
| B | 0 | 0 |
| C | 5 | 0 |
| D | 10 | 3 |
| E | 32 | 10 |

FIG.6

| NUMBER OF TIMES OF OPENING AND CLOSING MOVEMENT OF SHUTTER | TONER CONTAMINATION ON IMAGE (0.3 OR LESS) | TONER CONTAMINATION ON IMAGE (MORE THAN 0.3) | CONTAMINATION LEVEL OF SHUTTER |
|---|---|---|---|
| 0 | 42 | 16 | E |
| 5 | 19 | 3 | D |
| 10 | 3 | 0 | C |
| 15 | 0 | 0 | B |
| 20 | 0 | 0 | A TO B |

IMAGE FORMING APPARATUS HAVING TONER IMAGE FORMING DEVICE

BACKGROUND OF THE INVENTION

1. Field of the Invention

The present invention relates to an image forming apparatus using an electrophotographic method or an electrostatic recording method, particularly, an image forming apparatus such as a copying machine, printer, facsimile (FAX), and multifunction peripheral including a plurality of these functions.

2. Description of the Related Art

A conventional image forming apparatus such as a copying machine and printer using an electrophotographic method forms a patch image on a photosensitive member, and corrects image forming condition of an image forming process device based on a result of detected density of the patch image.

For example, an apparatus discussed in Japanese Patent Application Laid-Open No. 2005-316064 includes, in order to correct an image forming condition of an image forming process device, an image density sensor of an optical type at a position facing a photosensitive member.

Further, Japanese Patent Application Laid-Open No. 2005-316064 employs a configuration in which a detection window of the image density sensor is closed with a shutter when detection is not performed to prevent scattered toner from contaminating the image density sensor.

However, when the shutter is provided in the image forming apparatus, a new problem arises that the scattered toner adheres to an outer surface of the shutter.

If a large amount of toner adheres to the shutter, when the density of the patch image is detected during a job for continuously forming a plurality of images, the toner may be scattered from the shutter when the shutter is opened and closed, and adhere to a primary image.

In other words, every time the shutter is opened and closed to detect the density of the patch image, the toner scattered from the shutter may generate a fault in an image.

SUMMARY OF THE INVENTION

The present invention is directed to an image forming apparatus in which a fault in an image generated by toner adhering to a shutter is suppressed.

An image forming apparatus includes a toner image forming device configured to form a toner image on an image conveying member, a detector configured to optically detect a density of the toner image on the image conveying member, a controller configured to control an image forming condition of the toner image forming device based on an output of the detector, and a shutter configured to open and close an optical window of the detector. The image forming apparatus is operable in a cleaning mode of the shutter in which an opening and closing movement of the shutter is repeatedly executed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 3A illustrates a closed state and FIG. 3B illustrates an open state.

FIG. 5 illustrates contamination levels of the shutter and the number of times of generating a fault in an image due to a difference in image ratios.

FIG. 6 illustrates contamination levels of the shutter and the number of times of generating a fault in an image depending on the number of times of opening and closing movements of the shutter.

DETAILED DESCRIPTION OF THE EMBODIMENTS

Various exemplary embodiments, features, and aspects of the invention will be described in detail below with reference to the drawings.

First Exemplary Embodiment

Figure 1:
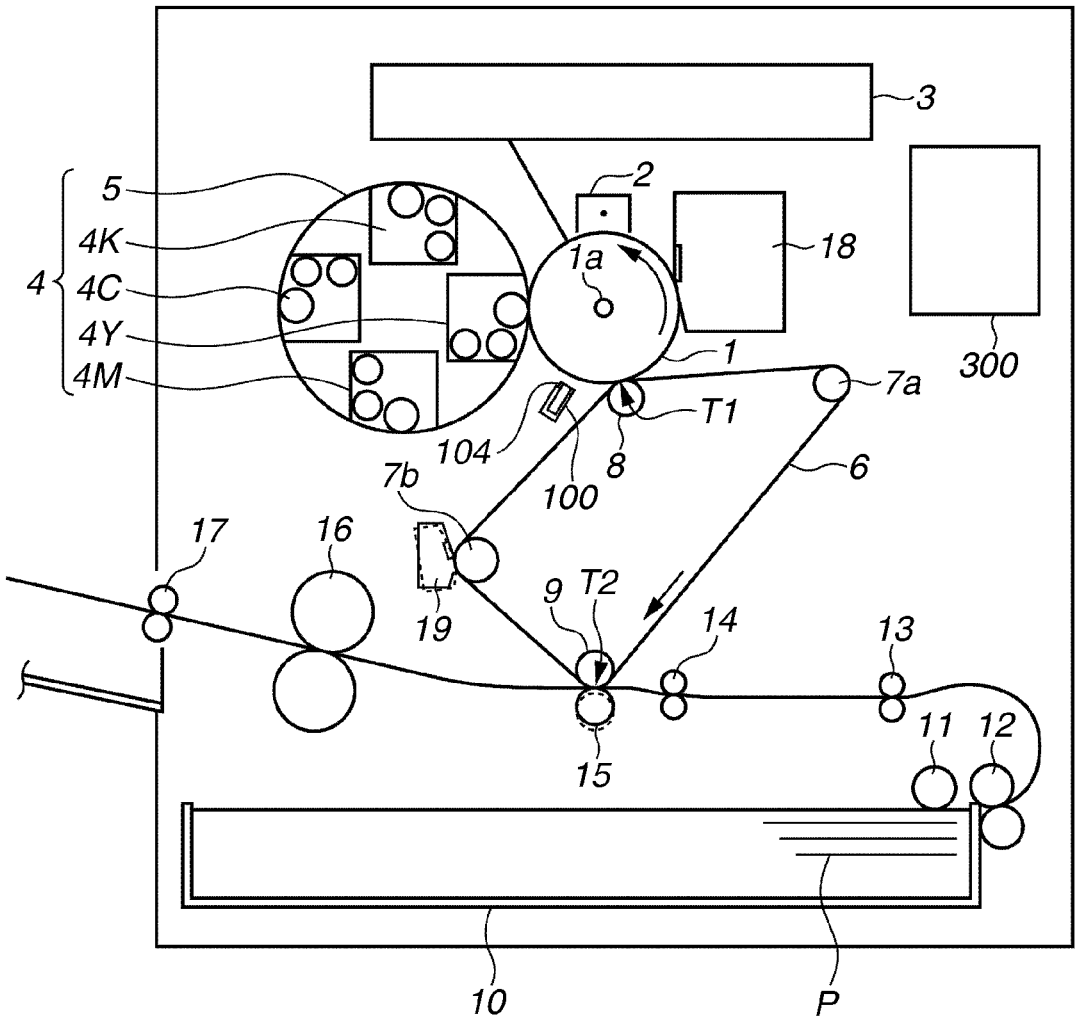
FIG. 1 is a sectional view illustrating an image forming apparatus according to an exemplary embodiment of the present invention.

FIG. 1 is a sectional view illustrating an image forming apparatus according to a first exemplary embodiment of the present invention. An engine portion of the image forming apparatus includes an electrophotographic photosensitive member serving as an image bearing member or an image conveying member, and a toner image forming device that forms a toner image on the photosensitive member.

The image forming apparatus according to the present embodiment is an image forming apparatus using an intermediate transfer belt.

A photosensitive drum 1 as an image bearing member is rotatably about a rotation shaft 1*a* provided. Over the photosensitive drum 1, a charging device 2 serving as an electrostatic image forming device and a laser unit 3 are disposed. The charging device 2 is used for uniformly charging a surface of the photosensitive drum 1. The laser unit 3 is used for selectively exposing the surface of the photosensitive drum 1 which has been uniformly charged, according to image signals to form an electrostatic latent image on the surface of the photosensitive drum 1.

A development device 4 is used for visualizing the electrostatic latent image formed on the photosensitive drum 1 with toner. The development device 4 includes four developing units 4Y, 4M, 4C and 4K for each toner of yellow (Y), magenta (M), cyan (C) and black (K). Each of these developing units 4Y, 4M, 4C and 4K is mounted on a rotatable rotary 5.

The rotary 5 rotates to selectively place the desired developing device at a developing position that faces the photosensitive drum 1. Each of the developing units contains two-component developer including toner and carrier.

Below the photosensitive drum 1, an intermediate transfer belt 6 serving as an image conveying member or transfer medium is rotatably suspended by a drive roller 7*a*, a driven roller 7*b*, a primary transfer roller 8, and a secondary transfer roller 9.

Bias voltage is applied to a transfer roller 8 (i.e., a transfer device). As a result, the toner images visualized with each of the developing devices 4Y, 4M, 4C and 4K are sequentially transferred at a transfer position T1 to generate a multi-transferred toner image on a surface of the intermediate transfer belt 6.

A recording material P serving as the transfer medium is fed from a feeding cassette 10 to a feed roller 11, a separation roller pair 12, a conveyance roller pair 13, and a registration roller pair 14. The recording material P waiting at the registration roller 14 is sent to a transfer position T2 in synchronization with the toner image on the intermediate transfer belt 6.

The transfer roller 15 is configured to freely contact with or keep away from the intermediate transfer belt 6. When a multi-transfer process is executed on the intermediate transfer belt 6, the transfer roller 15 keeps away from the intermediate transfer belt 6. When a transfer process onto the recording material is executed, the transfer roller 15 contacts the intermediate transfer belt 6. The toner images on the intermediate transfer belt 6 are collectively transferred onto the recording material P at the transfer position T2 owing to an effect of bias voltage applied to the transfer roller 15.

The toner image carried by the recording member P is fixed with heat and pressure generated by the fixing device 16. The recording member P is discharged to a discharge unit by discharge roller pairs 17.

The photosensitive drum 1 is provided with a drum cleaner 18, and the intermediate transfer belt 6 is provided with a transfer cleaner 19. Both of the cleaners employ a blade cleaning method. The drum cleaner 18 cleans off toner that has not been transferred to the transfer belt and remains on the photosensitive member in a primary transfer process. The transfer cleaner 19 is configured to freely contact with and keep away from the intermediate transfer belt 6, and cleans off toner that has not been transferred and remains on the intermediate transfer belt 6.

According to the present embodiment, at a position downstream of a developing position and upstream of the transfer position T1 in a rotational direction of the photosensitive drum 1, a density sensor unit 100 serving as a detector is disposed. The density sensor unit 100 and the photosensitive drum 1 are disposed close to each other.

The density sensor unit 100 is used to detect density of a patch image formed under preset conditions of outputting the images and control conditions of image formation by a controller (central processing unit (CPU)) 300.

More specifically, the controller 300 controls a toner supply amount to the development device 4 based on a density detection result of the patch image detected by the image density sensor 100. Further, the controller 300 adjusts an exposure light amount of the laser unit 3 based on the result of density detection by the image density sensor 100 and controls the output image density.

Figure 2:
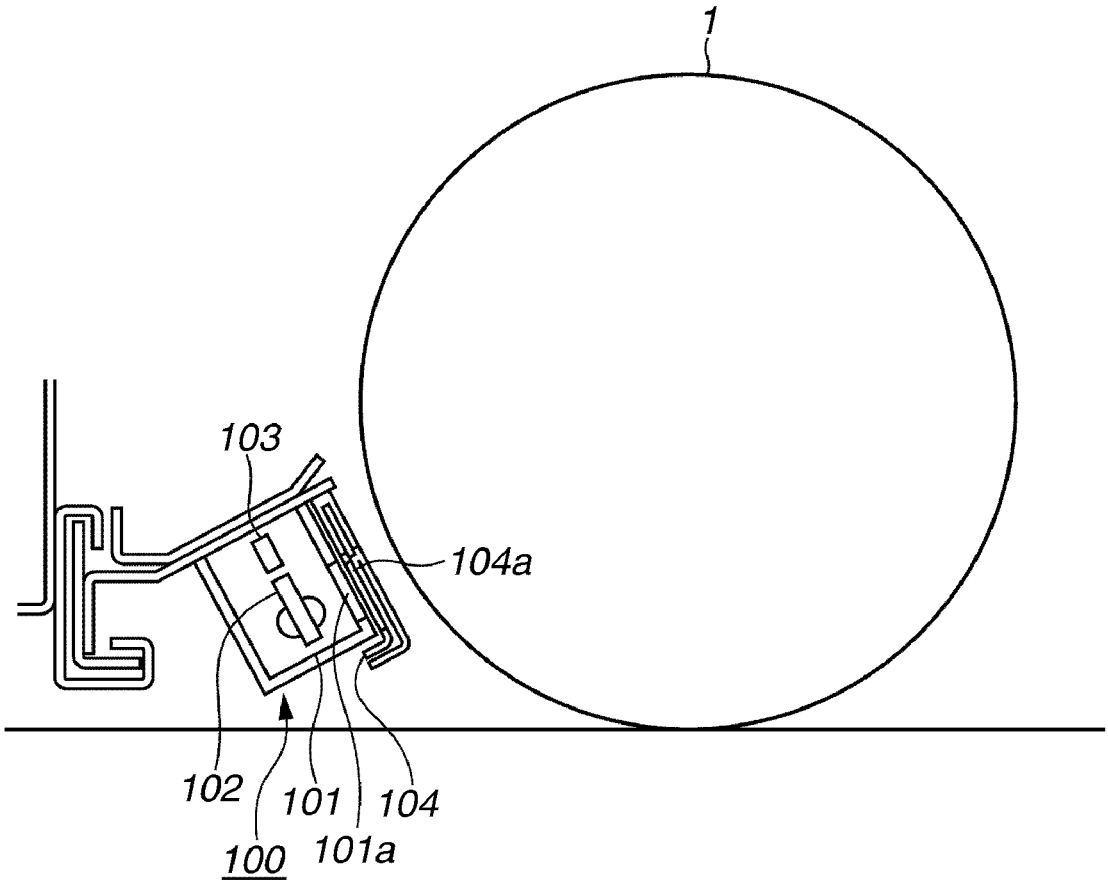
FIG. 2 is a detailed view illustrating an image density sensor.

FIG. 2 is a detailed view illustrating relationships between the photosensitive drum 1 and the density sensor unit 100 illustrated in FIG. 1.

The image density unit 100 includes a light emitting element 102 and a light receiving element 103 provided within a casing 101. The light emitting element 102 emits light through a window portion 101*a* that is an optical window of the casing 101, onto the surface of the photosensitive drum 1. The light receiving element 103 in the casing detects light of the patch image reflected on the photosensitive drum 1 through the window portion 101*a*. The window portion 101*a* is made from a light transmissive member such as acrylic.

If a large amount of scattered toner adheres to a surface of the window portion 101*a* of the casing 101, accuracy of density detection of the patch image is deteriorated. However, as will be described below, the present embodiment is provided with a shutter 104 for opening and closing the window portion 101*a*.

The present embodiment is provided with the shutter 104 as a shielding member between the window portion 101*a* and the surface of the photosensitive drum 1. The shutter 104 is controlled to open when the patch image comes closer to a portion facing the window portion 101*a*, and to close when the patch image passes the portion facing the window portion 101*a*.

Thus, it is possible to prevent contamination of the window caused by the toner adhering to the window portion 101*a* of the casing 101. The shutter 104 is configured to linearly make an opening and closing movement in a rotational-axis direction of the photosensitive drum 1 along a shutter guide 120 illustrated in FIG. 4.

The shutter 104 is provided with an aperture 104*a*.

The opening and closing movements of the shutter 104 are driven by a solenoid 105 via an arm 106.

Figure 3A:
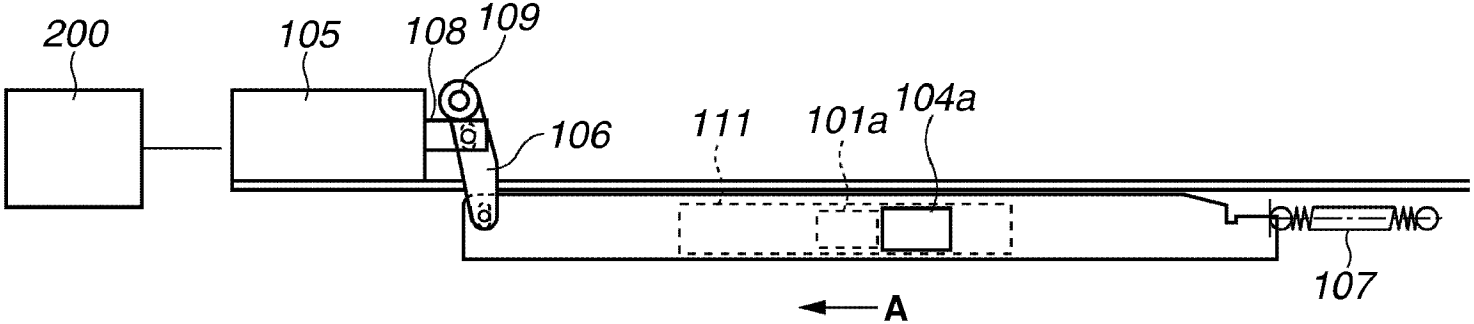
FIGS. 3A and 3B illustrate an opening and closing mechanism of a shutter.

FIG. 3A illustrates a state where the shutter 104 is pulled by a spring 107 so that the aperture 104*a* of the shutter does not face the window portion 101*a* and the window portion 101*a* is closed. On the other hand, FIG. 3B illustrates a state where the aperture 104*a* of the shutter 104 faces the window portion 101*a* so that the shutter 104 is opened to detect the density of the patch image.

An opening and closing system of the shutter 104 is configured as follows. The state illustrated in FIG. 3A is a default state. The solenoid 105 is excited from the default state. Then, a solenoid plunger 108 actuated by a solenoid 105 pulls the arm 106, which rotates about a pivot 109 to move the shutter 104 in an arrow A direction.

Figure 3B:
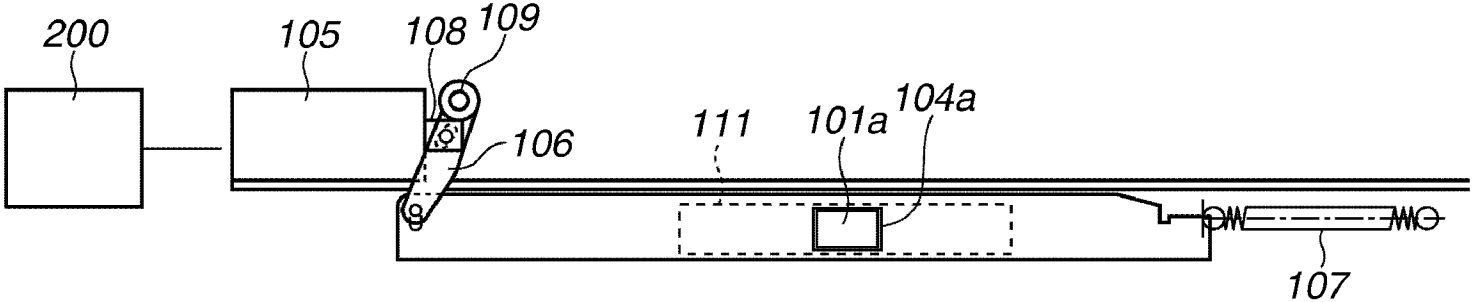

When the plunger 108 completely pulls off the arm 106 as illustrated in FIG. 3B, a position of the window portion 101*a* coincides with the aperture 104*a* so that the shutter 104 is opened. In the opened state, the density of the patch image can be detected.

After the density of the patch image has been detected, when the solenoid 105 is not excited, the shutter 104 slides back in a direction opposite to the arrow A due to a restoring force of the spring 107. Accordingly, the state of FIG. 3A is restored.

A shutter controller 200 controls a movement of solenoid 105. As the patch image comes closer to the portion facing the window portion 101*a*, the shutter controller 200 opens the shutter as illustrated in FIG. 3B. On the other hand, when the density detection of the patch image is completed (when the patch image passes the portion facing the window portion 101*a*), the shutter 104 is moved back in a closing direction opposite to an opening direction to close the shutter 104 as illustrated in FIG. 3A.

The present embodiment is further configured to include a cleaning member 111 on a surface of the shutter 104 facing the casing 101. The cleaning member 111 cleans the window portion 101*a* along with the opening and closing movements of the shutter 104. Thus, if the toner adheres to the window portion 101*a*, only with opening and closing movements of the shutter 104, the toner can be cleaned off.

Next, with reference to FIG. 8, control for opening and closing the shutter 104 by the shutter controller 200 will be described.

Figure 8:
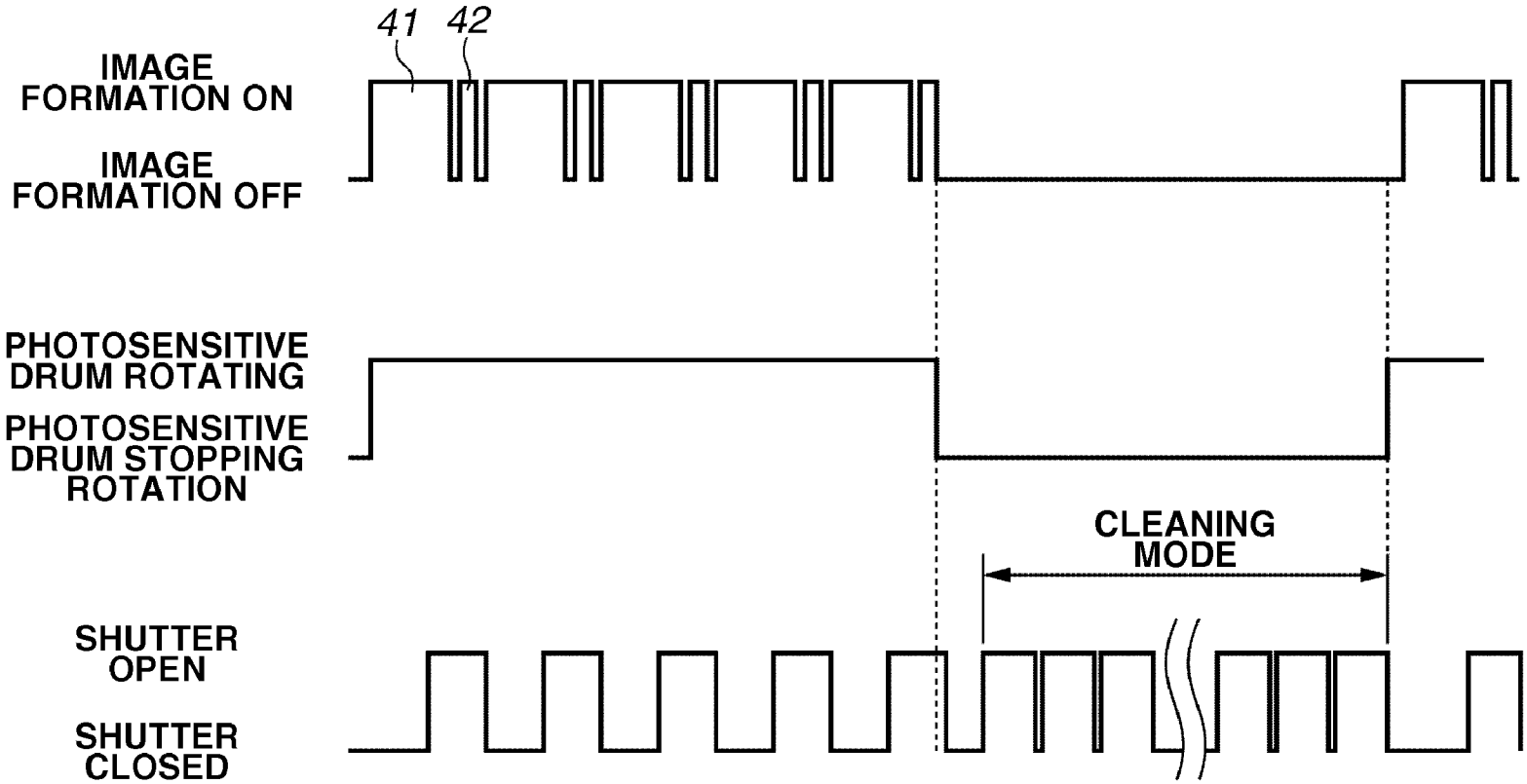
FIG. 8 is a timing chart of a cleaning mode according to the exemplary embodiment of the present invention.

A timing chart in FIG. 8 illustrates a continuous job that successively forms images on a plurality of recording members. During the job, patch images are sequentially formed between primary images to detect the density of the patch images. That is, FIG. 8 illustrates a primary image forming period 41 and a patch image forming period 42.

As illustrated in FIG. 8, when a patch image forming signal is input into a controller 300 illustrated in FIG. 1 during the job, the patch image is formed at a position between the primary images on the photosensitive drum 1.

When a predetermined time has elapsed since the patch image forming signal was input into the controller 300, the shutter controller 200 moves the shutter 104 to open the window portion 101*a*.

When a predetermined time has elapsed since the shutter 104 was opened, that is, when the density detection of the patch image is completed, the shutter 104 is moved to close the window portion 101*a*. When the shutter 104 executes a closing movement, a next primary image is already placed at the position facing the window portion 101*a*.

The closing movement of the shutter 104 may also be executed when a predetermined time has elapsed since the detection of the density of the patch image was completed.

The detection of the density of the patch image as described above, that is, the opening and closing movements of the shutter 104 are repeatedly executed every time the patch image reaches the position facing the window portion 101*a*.

The shutter controller 200 inserts a mode of cleaning the shutter 104 at a predetermined timing during the continuous job. A timing of insertion of the cleaning mode will be described later. When the cleaning mode is inserted as described above, the continuous job is temporarily suspended.

During the cleaning mode, a motor driving the photosensitive drum 1 is turned off so that the photosensitive drum 1 stops rotation. At this point, a motor driving the development device 4 is also turned off. Further, charging bias and developing bias are also turned off.

In the cleaning mode, the shutter controller 200 executes the continuous opening and closing movements ten times, and finally stops the movement of the shutter 104 with the window portion 101*a* closed.

When the cleaning mode is completed, that is, when the continuous opening and closing movements of the shutter 104 are completed after the opening and closing movements are repeated ten times, the cleaning mode is cancelled to resume the continuous job.

Figure 4:
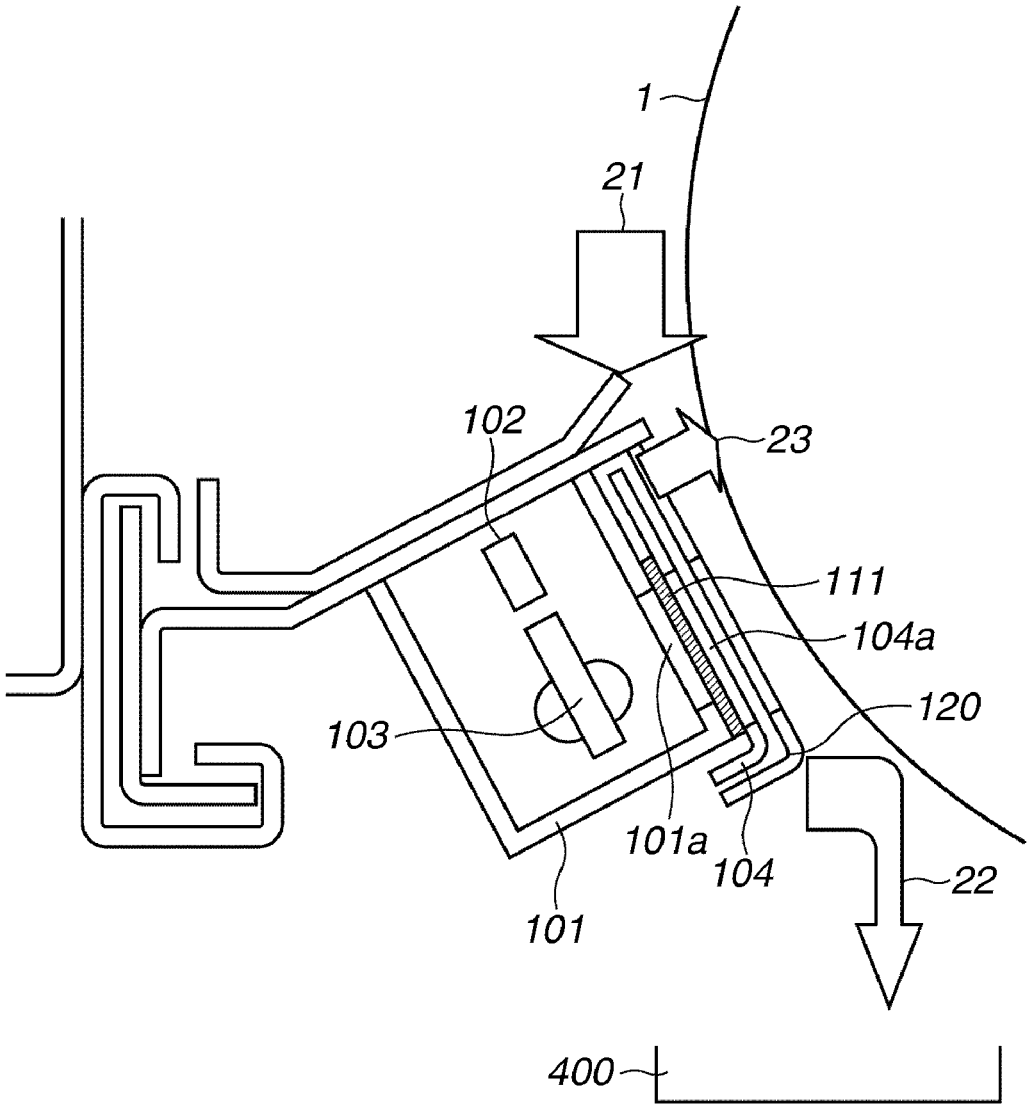
FIG. 4 is a diagram illustrating movements of scattered toner near the image density sensor and shutter.

Next, it is described through what routes scattered toner accumulated on an outer surface of the shutter 104 moves to the photosensitive member due to a shake caused by the opening and closing movements of the shutter 104, with reference to FIG. 4.

In FIG. 4, an arrow 21 illustrates a route through which the toner scattered from the developing units 4Y, 4M, 4C and 4K accumulates on an outer surface of the shutter 104. An arrow 22 illustrates a route through which the toner accumulated on the surface of the shutter 104 drops right under the shutter 104. An arrow 23 illustrates a route through which the toner accumulated on the surface of the shutter 104 travels to the photosensitive drum 1.

In the present embodiment, the toner having dropped through the route 22 is received and collected by a toner receiver (collecting container) 400 disposed below the image density sensor unit 100.

On the other hand, the toner traveling to the photosensitive drum 1 through the route 23 is a problem. Atoner amount and frequency of traveling of the toner to the photosensitive drum 1 increase as a gap between the image density sensor unit 100 (shutter 104) and the photosensitive drum 1 is made narrower to increase detection accuracy.

The toner amount accumulated on the shutter 104 increases as the toner amount scattered during the opening and closing movements of the shutter 104 increases. Thus, the scattered toner on the primary image is readily visualized.

Therefore, it is desirable that the toner amount accumulated in the shutter 104 should be maintained under a predetermined amount so that the toner scattered during the opening and closing movements of the shutter 104 is not visualized.

For that purpose, in the present embodiment, before the toner amount accumulated on the shutter 104 is increased to an amount enough to affect the primary image, the cleaning mode is executed to reduce or eliminate the toner accumulated on the outer surface of the shutter 104.

Next, image ratios and contamination levels of the shutter 104 are discussed. As illustrated in FIG. 5, a toner contamination level of the shutter 104 that depends on difference of the image ratios of the primary images was examined. Reference symbols A to E mean the toner contamination levels of the shutter 104. Here, the number of image signals for one image in one image region is counted. The image ratio refers to a ratio of the image in one image region.

Image ratio 10%: Level A (almost no toner contamination)

Image ratio 50%: Level B (minor amount of toner contamination)

Image ratio 70%: Level C (toner contamination)

Image ratio 80%: Level D (major amount of toner contamination)

Image ratio 95%: Level E (large amount of toner contamination)

The toner contamination of the shutter 104 was counted for two cases, that is, where a size of a fault portion in an image caused by the toner scattered from the shutter 104 is more than 0.3 mm, and where a size thereof is 0.3 mm or less.

In the examination of the toner contamination, a number of appearances of the fault in the image when 100 images are continuously formed on A3-size papers, was counted. On the assumption that the density of the patch image is to be detected, the opening and closing movements of the shutter 104 are once executed every time the image of an A3-size paper is formed. Since the shutter 104 executes the closing movement when the toner image is placed at a position facing the image density sensor unit 100, a lump of toner scattered along with the opening and closing movement of the shutter 104 may travel to the toner image.

Image forming speed (rotation speed of the photosensitive drum 1): 300 mm/s

Time from completing the formation of a preceding image to starting the formation of a subsequent image: 200 msec Time for detecting density by an image density sensor unit 100: 50 mmsec Time for opening and closing the shutter 104 (one way): 100 mmsec It was found that the toner contamination is not visualized on the image if the toner contamination of the shutter 104 is maintained at the level A or B.

Next, FIG. 6 illustrates a result obtained by examining the number of appearances of fault images with respect to the number of the opening and closing movements of the shutter 104 that are executed in the cleaning mode.

More specifically, after the toner has been accumulated such that the toner lump is scattered from the shutter 104 (when the number of the movements of the shutter 104 is 0), it was examined how many times the opening and closing movements of the shutter 104 need to be executed so that no image faults are generated when the subsequent primary image is formed.

This examination was executed under conditions that are described as follows. First, [1] hundred black-solid images (A3-size papers) having 100% of the image ratio are continuously formed (the number of opening and closing of the shutter 104 is 0). [2] The opening and closing movements of the shutter 104 are repeated the set number of times.

Then, [3] When hundred white-solid images (A3-size papers) having 0% of the image ratio are continuously formed, the number of the white-solid images to which the toner transferred from the shutter 104 adheres was counted.

As illustrated in FIG. 6, even if the shutter 104 is contaminated with the toner, the opening and closing movements of the shutter removed the toner accumulated on the outer surface of the shutter 104 so that the toner contamination is reduced. The contamination level of the shutter 104 was determined by the level of the toner contamination of the shutter 104 after the opening and closing movements of the shutter 104 are completed.

In order to maintain the contamination level of the shutter 104 at the level A or B, it is desirable that the opening and closing movements of the shutter 104 are executed to clean the shutter 104 other than when the density of the patch image is detected.

In the present embodiment, therefore, the shutter controller 200 inserts the opening and closing movements of the shutter 104, that is, the cleaning mode during the job based on the image ratio when the number of times the images are formed, that is, image formation history information, reaches the predetermined number of times (the number of forming the images reaches the predetermined number).

The image formation history refers to data corresponding to the image ratios from one to a plurality of primary images which were formed in the past. In the present embodiment, the image formation history refers to an average value of the image ratios per image obtained when the number of image formations reaches the predetermined number. However, it is not limited thereto, but it may also be a value of a toner consumption amount or a toner supply amount relative to the image ratio.

Further, the cleaning mode of the shutter 104 may be executed based on only the number of times the images are formed as a trigger of an execution timing.

Figure 7:
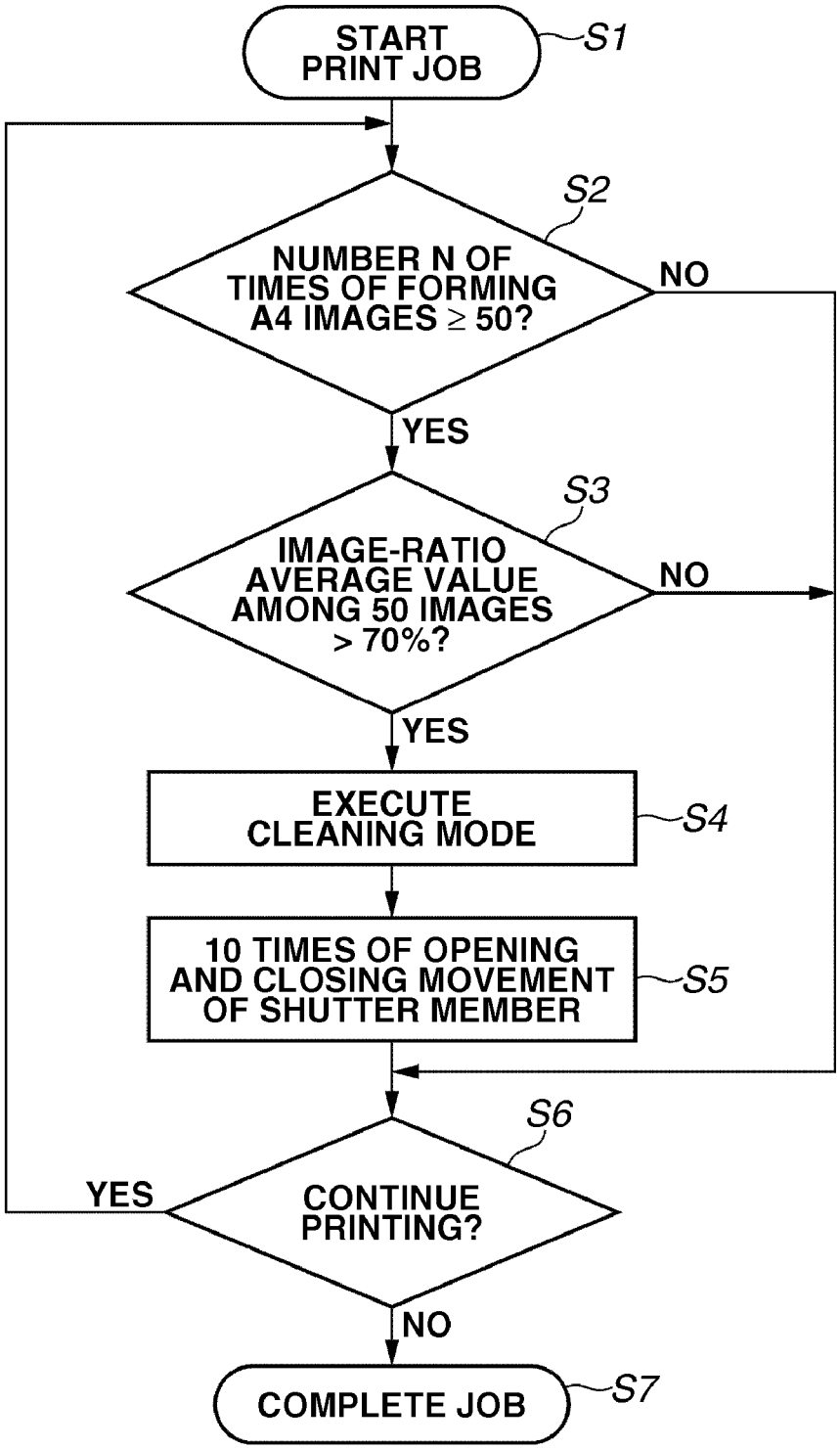
FIG. 7 is a flowchart illustrating an execution of a cleaning mode according to the exemplary embodiment of the present invention.

FIG. 7 illustrates a flowchart for executing the cleaning mode of the shutter 104. In the flowchart, the controller 300 enables the shutter controller 200 to move the solenoid 105 to execute the cleaning mode. During the continuous print job for continuously forming the plurality of images, the patch image is formed between the primary images, and the shutter 104 is opened and closed to detect the image density.

In step S1, the continuous print job is started. The controller 300 counts the number of times the images are formed and stores the counted number in a memory. In step S2, every time the image is formed, the controller 300 determines whether the counted number reaches fifty.

When the number of times of image formations is less than fifty (NO in step S2), the controller 300 continues the image forming movements without inserting the cleaning mode (YES in step S6).

When the number of times of image formations reaches fifty (YES in step S2), the controller 300 calculates the average image ratio per image. In other words, the controller 300 totalizes the image data, and then divides the totalized value by fifty to calculate the image ratio per image formation.

Here, calculation of the image ratio will be described. First, as a route for outputting the image, image information input to an image processing unit that is a part of the controller 300 is converted into a signal and sent to a printer controller that executes image formation with the image signal. An image ratio calculation unit in the controller 300 counts the image signal and stores the counted numbers in the memory. The image ratio calculation unit calculates the image ratio based on the counted image signal.

In other words, the number of the image signals in one image (i.e., an amount of image portion in one image region) is counted to acquire the image ratio. The present embodiment uses the image ratio for one image formation (for one sheet of the recording member). Thus, the image ratio is 100% for a solid image while the image ratio is 0% for no image.

In step S3, the controller 300 determines whether the average value of the image ratios exceeds 70%. If the average value of the image ratios exceeds 70% (YES in step S3), in step S4, the controller 300 enables the shutter controller 200 to execute the cleaning mode. That is, the controller 300 temporarily suspends the continuous print job to execute the cleaning mode.

In step S5, the shutter controller 200 repeats the cleaning mode until the continuous opening and closing movements of the shutter 104 are repeated ten times. Finally, the shutter controller 200 stops the movement of the shutter 104 with the window portion 101*a* shielded.

On the other hand, if the average value of the image ratios is 70% or less (NO in step S3), the controller 300 continues the print job without inserting the cleaning mode during the job (YES in step S6). When the cleaning mode is not inserted, as long as the image formation is continuously performed, the average value of the image ratios in the last fifty image formations is being updated.

When the cleaning mode is completed, the controller 300 clears the number of times the images are formed and the image ratios data in the last fifty image formations which are stored in the memory. When the job is continued, the controller 300 starts counting the number of image formations and the image ratios again, and sequentially stores the counted number in the memory.

As long as the job continues (YES in step S6), the above-described sequence is repeated. Finally, the job is completed (NO in step S6, and in step S7).

As described above, in the present embodiment, a timing of executing the cleaning mode is determined every time the number of image formations on A4-size papers reaches fifty. However, the timing of executing the cleaning mode may also be determined every time the number of image formations on A3-size papers reaches twenty-five. Thus, it is desirable that the number of image formations that is a reference for executing the cleaning mode is changed depending on a size of the recording member.

Further, in the present embodiment, when the number of image formations reaches fifty during the job, it is determined whether the cleaning mode is executed. However, the average value of the image ratios may also be calculated when the number of times reaches a predetermined number that is less than fifty. More specifically, the average value may be calculated when the number of image formations reaches thirty five, and it is determined whether the cleaning mode may be executed.

Figure 9:
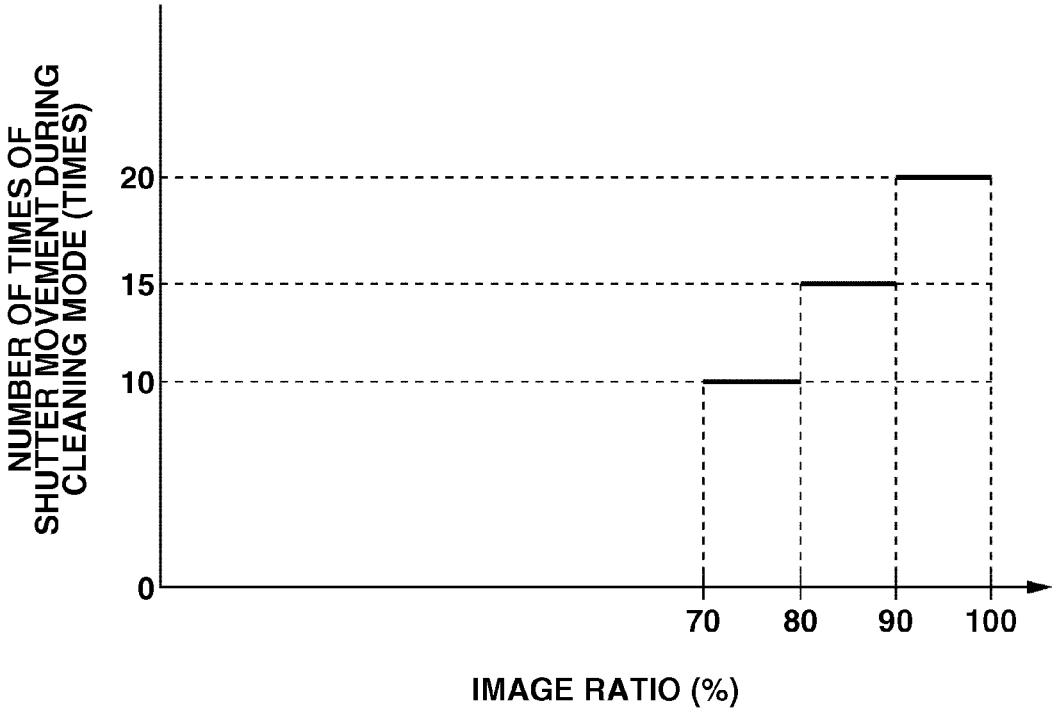
FIG. 9 illustrates relationships between image ratios and the number of times of operating and closing movements of the shutter in the cleaning mode.

In the present embodiment, if the acquired image ratio is more than 70%, the number of the opening and closing movements of the shutter 104 in the cleaning mode is set to ten. However, it is desirable that the shutter controller 200 changes the number of the opening and closing movements of the shutter 104 in the cleaning mode depending on the image ratio. More specifically, as illustrated in FIG. 9, when an acquired image ratio is large, the number of the opening and closing movements of the shutter 104 in the cleaning mode is increased.

Second Exemplary Embodiment

A second exemplary embodiment of the present invention has a similar configuration to the first exemplary embodiment except for the following descriptions. Accordingly, the same reference numerals are assigned to similar components and the detailed descriptions thereof will be omitted.

In the second exemplary embodiment, the timing of execution of the cleaning mode is determined depending on the contamination level (light transmissivity) on a detection surface of the image density sensor unit 100.

First, contamination of the image density sensor will be described.

Depending on usage history of the image formation, a relationship between a toner-contamination amount adhering to the image density sensor unit 100 and a toner cleaning amount removed by the cleaning member 111 (refer to FIGS. 3A, 3B, and 4) that is disposed inside the shutter 104 is different. Particularly, when images having high image ratios are continuously formed, the toner hanging near the shutter 104 is increased. Thus, the toner easily adheres to the window portion 101*a* when the shutter 104 is open.

Accordingly, the present embodiment employs light transmissivity of the window 101*a* as an index corresponding to the toner contamination of the window portion 101*a* that is related to the image ratio. The light transmissivity is obtained by comparing reference light to reflected light from the photosensitive drum 1 onto which the toner is not transferred. The reference light refers to a light amount of the light emitting element 102 in the image density sensor unit 100. The reflected light from the surface of the photosensitive member is light reflected from the photosensitive drum 1 when the light is emitted from the light emitting element 102 in the image density sensor unit 100 to the photosensitive drum 1.

Even though the window portion 101*a* is contaminated with the toner, the light amount of the light emitting element 102 (light source) can be changed. Accordingly, the density of the patch image on the photosensitive drum 1 can be detected without any problems.

Figure 10:
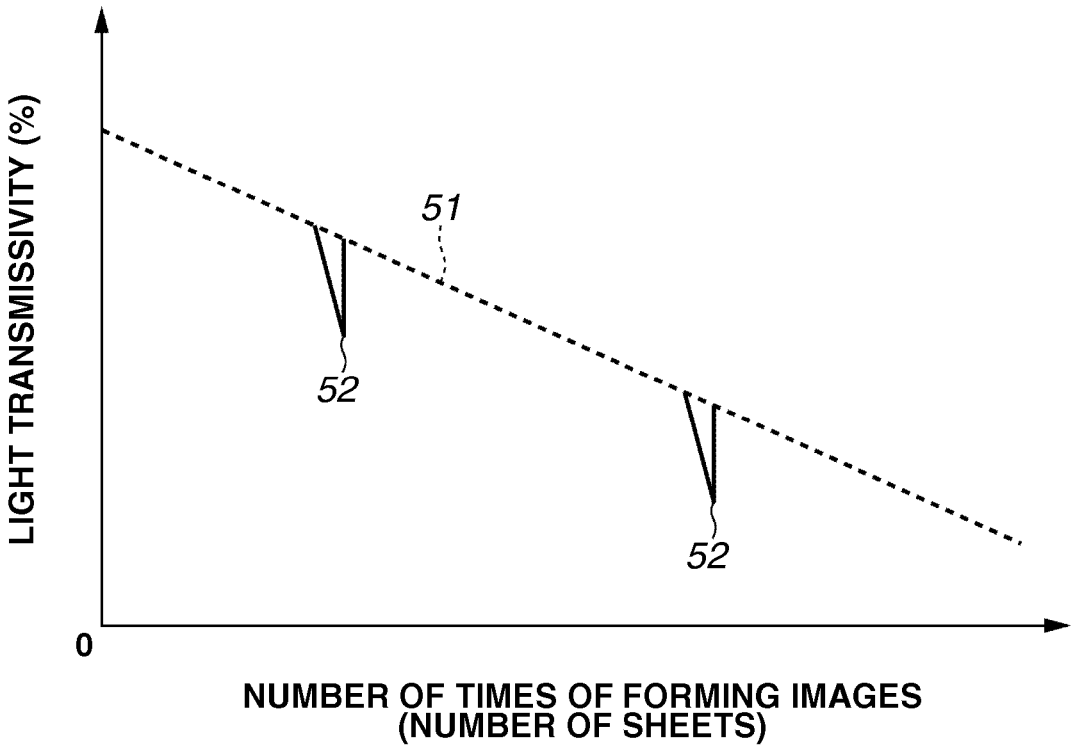
FIG. 10 illustrates relationships between the number of sheets of forming images and light transmissivity.

FIG. 10 illustrates a change of the light transmissivity (%) of the window portion 101*a* relative to the cumulative number of image formations. Until duration life of the sensor expires, the light transmissivity of the window portion 101*a* is gradually lowered due to the contamination of the toner adherence and the like (a dotted line 51 in FIG. 10).

When the images having the high image ratios are continuously formed, the light transmissivity is more lowered than expected (a solid line 52 in FIG. 10). In the present embodiment, by using this solid line 52, the timing of execution of the cleaning mode is determined.

Figure 11:
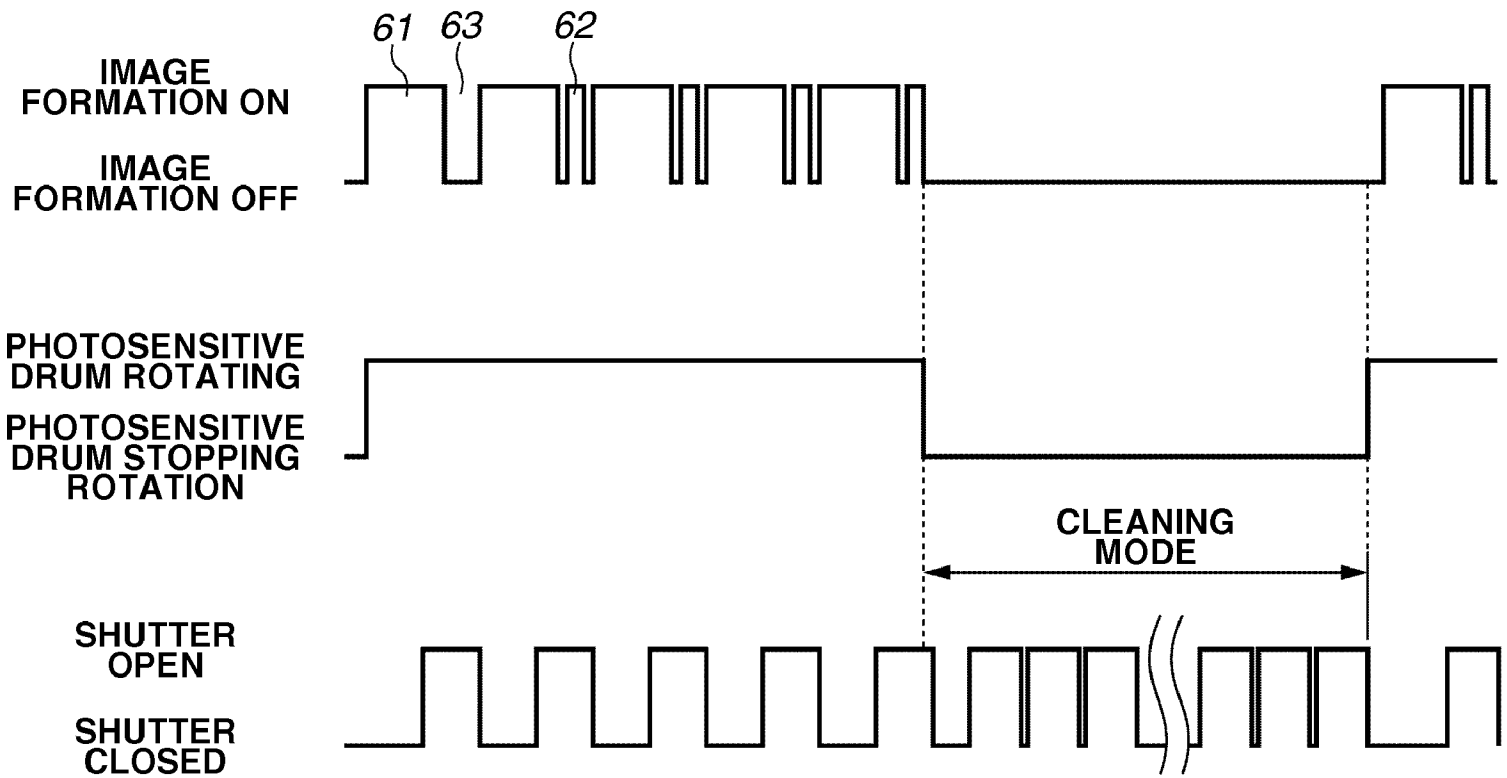
FIG. 11 is a flowchart illustrating an execution of a cleaning mode according to the exemplary embodiment of the present invention.

FIG. 11 illustrates a timing chart for measuring the light transmissivity. FIG. 11 and FIG. 8 are substantially the same. Periods 61 and 62 illustrated in FIG. 11 are similar to a primary image forming period 41 and a patch image forming period 42 illustrated in FIG. 8 respectively. A period 63 will be described below.

In the present embodiment, the detection of the light transmissivity is performed in a non-image region where the patch image is not formed at timing between a preceding primary image and a subsequent primary image (a period 63 in FIG. 11). The controller 300 calculates the light transmissivity based on the reflected light measured at the timing of the period 63 and stores the calculated light transmissivity in the memory. The controller 300 sets a threshold value to a ratio of change of the light transmissivity from the past in order to determine the timing of execution of the cleaning mode.

In the present embodiment, the controller 300 determines the toner contamination level of the shutter 104 based on history (ratio of change) of the light transmissivity of the window portion 101*a*. That is, when the light transmissivity measured this time is largely reduced compared to a previous time, the controller 300 determines that the job for forming the images having the higher image ratios has been executed.

Figure 12:
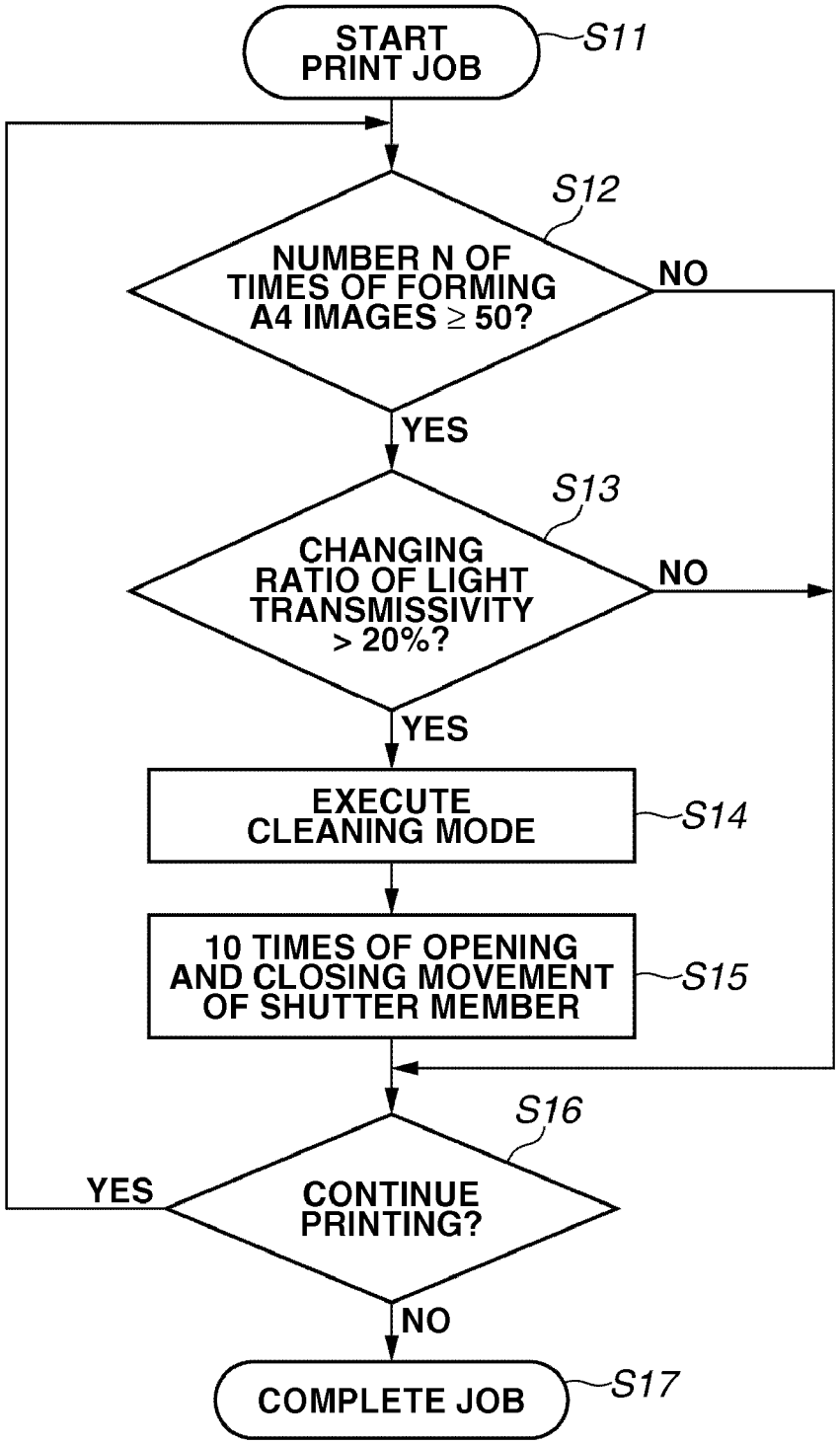
FIG. 12 is a timing chart of a cleaning mode according to the exemplary embodiment of the present invention.

A flow for setting the threshold value to the ratio of change of the contamination level (light transmissivity) of the window portion 101*a*, inserting the cleaning mode when the ratio of change reaches the threshold value, and forcibly opening and closing the shutter 104 will be described with reference to FIG. 12. In the flow, the controller 300 also enables the shutter controller 200 to move the solenoid 105 to execute the cleaning mode.

In step S11, continuous print job is started. The controller 300 counts the number of times the images are formed and stores the counted number in the memory. In step S12, every time the image is formed, the controller 300 determines whether the counted number reaches fifty. When the number of image formations is less than fifty (NO in step S12), the controller 300 continues the image forming movements without inserting the cleaning mode (YES in step S16).

When the number of image formations reaches fifty (YES in step S12), the controller 300 calculates the ratio of change of the light transmissivity for fifty image formations. That is, the controller 300 detects the light transmissivity at the time of first image formation when starting to count the number and the light transmissivity detected when the number of image formations reaches fifty in order to calculate reduction of the light transmissivity. The reduction can be calculated by a following expression.

(transmissivity for the fiftieth time/transmissivity for the first time)×100(%)

In step S13, the controller 300 determines whether the reduction exceeds 20%. When the reduction exceeds 20% (YES in step S13), in step S14, the controller 300 executes the cleaning mode. That is, the controller 300 suspends the continuous print job to execute the cleaning mode.

In step S15, the shutter controller 200 repeats the cleaning mode until the shutter 104 repeats continuous opening and closing movements ten times. Finally, the shutter controller 200 stops the movements of the shutter 104 with the window portion 101*a* shielded.

When the reduction is 20% or less (NO in step S13), the controller 300 continues the print job without inserting the cleaning mode (YES in step S16).

When the cleaning mode is completed, the controller 300 clears counted values of the number of image formations. When the job is continued (YES in step S16), the controller 300 starts counting the number of image formations and repeats a sequence described above. At last, the controller 300 completes the job (NO in step S16, and in step S17).

In the present embodiment, when the reduction is larger than 20%, the number of opening and closing movements of the shutter 104 in the cleaning mode is set to ten. However, the shutter controller 200 may change the number of opening and closing movements of the shutter 104 depending on a value of the reduction. More specifically, the number of movements of the shutter 104 is increased as the reduction is increased.

According to the first and second exemplary embodiments, the cleaning mode is automatically inserted and executed during the image forming job. Further, the cleaning mode may also be executed when a post-rotation is performed during a post process in the image forming apparatus after completing the image forming job. Furthermore, the cleaning mode may also be executed when a pre-rotation is performed during a pre-process in the image forming apparatus in a period after a starting signal is input and before the image forming movement is started.

According to the first and second exemplary embodiments, the image density sensor unit is disposed at a position facing the photosensitive drum 1 to detect the density of the patch image formed on the photosensitive drum 1, however, the following configuration may also be employed. The image density sensor unit may be disposed at a position facing the intermediate transfer member to detect the density of the patch image transferred onto the intermediate transfer member from the photosensitive drum 1.

According to the first and second exemplary embodiments, the controller 300 and the shutter controller 200 are configured to issue instructions and directions for executing the cleaning mode. However, the following configuration may also be employed. That is, when the image forming apparatus is used as a printer connected to a host computer through a local area network (LAN) cable, the cleaning mode may be executed based on an instruction of a user from the host computer.

In this case, an interface unit of the image forming apparatus receives a start signal of the cleaning mode from the host computer through the LAN cable. Based on the start signal, the shutter controller 200 drives the solenoid 105. As a result, the shutter 104 repeats the opening and closing movements a plurality of times to perform the cleaning of the shutter 104.

In the first and second exemplary embodiments, the cleaning mode of the image density sensor unit 100 and the shutter 104 is described. However, the present invention can also be applied to the following configuration.

Figure 13:
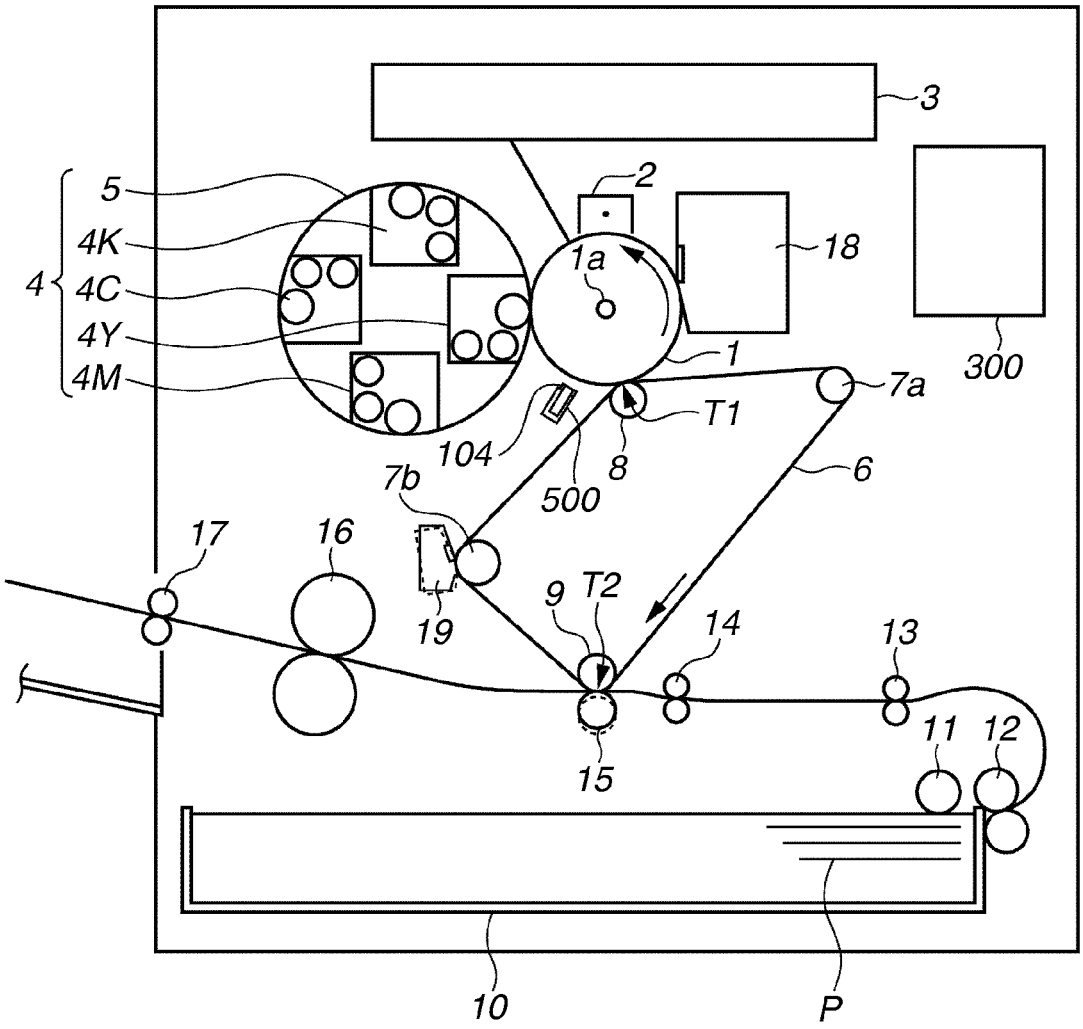
FIG. 13 is a sectional view illustrating the image forming apparatus in which a corona charging device is provided according to the exemplary embodiment of the present invention.

As illustrated in FIG. 13, it is possible to apply the present invention to the shutter 104 of the corona charging device 500 serving as a charger facing the photosensitive drum 1. The corona charging device 500 includes a shield and a discharge wire disposed therein, and discharges electricity toward the toner image formed on the photosensitive drum 1 so that efficiency of transferring images onto the intermediate transfer member is improved.

In this case, in order to prevent the toner from entering within the shield of the corona charging device 500, the shutter 104 for opening and closing the aperture is formed in the shield similar to the above exemplary embodiments. In order to perform the cleaning on the shutter 104, the cleaning mode is executed similar to the above exemplary embodiments.

Thus, in the image forming apparatus that uses the corona charging device 500 as illustrated in FIG. 13, it is possible to provide the shutter 104 at the aperture of the shield of the corona charging device 500 in place of the image density sensor unit 100 according to the first and second exemplary embodiments, and execute the similar opening and closing movements for cleaning the shutter 104. The corona charging device 500 may also be disposed facing the intermediate transfer member to charge the toner image on the intermediate transfer member. Also in this case, the present invention can be applied.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-181111 filed Jul. 10, 2007, which is hereby incorporated by reference herein in its entirety.

What is claimed is:

1. An image forming apparatus comprising:

a toner image forming device configured to form a toner image on an image conveying member;

a detector configured to optically detect a density of the toner image on the image conveying member;

a controller configured to control an image forming condition of the toner image forming device based on an output of the detector;

a shutter configured to open and close an optical window of the detector, wherein the image forming apparatus is operable in a cleaning mode of the shutter; and a shutter controller configured to execute the cleaning mode of the shutter in which an opening and closing movement of the shutter is repeatedly executed while the toner image on the image conveying member is in a position different from a position opposite to the detector.

2. The image forming apparatus according to claim 1, further comprising a shutter controller configured to control a timing of execution of the cleaning mode based on a number of image formations.

3. The image forming apparatus according to claim 1, further comprising a shutter controller configured to variably control a number of the opening and closing movements in the cleaning mode.

4. The image forming apparatus according to claim 1, wherein the image conveying member includes an electrophotographic photosensitive member.

5. The image forming apparatus according to claim 4, wherein the detector is disposed at a position that is on a downstream, relative to a rotational direction of the photosensitive member, side of a developing position where an electrostatic image on the photosensitive member is developed with toner, and that is on an upstream, relative to the rotational direction, side of a transfer position where the toner image on the photosensitive member is transferred.

6. An image forming apparatus comprising:

a toner image forming device configured to form a toner image on an image conveying member;

a detector configured to optically detect a density of the toner image on the image conveying member;

a controller configured to control an image forming condition of the toner image forming device based on an output of the detector;

a shutter configured to open and close an optical window of the detector; and a shutter controller configured to control a moving operation of the shutter;

wherein the shutter controller executes a cleaning mode of the shutter in which an opening and closing movement of the shutter is repeatedly executed while no image is formed, when a signal to start the cleaning mode is input.

* * * * *